United States Patent [19]

Peter

[11] Patent Number: 4,947,815

[45] Date of Patent: Aug. 14, 1990

[54] SYSTEM FOR REGULATED DOSING OF COMBUSTION AIR INTO INTERNAL COMBUSTION ENGINE

[75] Inventor: Cornelius Peter, Ottersweier, Fed. Rep. of Germany

[73] Assignee: Robert Bosch GmbH, Stuttgart, Fed. Rep. of Germany

[21] Appl. No.: 347,801

[22] PCT Filed: Sep. 4, 1987

[86] PCT No.: PCT/DE87/00404

§ 371 Date: Mar. 13, 1989

§ 102(e) Date: Mar. 13, 1989

[87] PCT Pub. No.: WO88/02064

PCT Pub. Date: Mar. 24, 1988

[30] Foreign Application Priority Data

Sep. 13, 1986 [DE] Fed. Rep. of Germany ..... 3631283

[51] Int. Cl.[5] ..... F02D 9/02; F02D 11/10

[52] U.S. Cl. ..... 123/399; 123/361

[58] Field of Search ..... 123/361, 399, 403, 328

[56] References Cited

U.S. PATENT DOCUMENTS

| | | | |
|---|---|---|---|
| 2,766,004 | 10/1956 | Lindow | 251/285 |
| 4,060,063 | 11/1977 | Hirasawa | 123/328 |
| 4,383,510 | 5/1983 | Nakamura et al. | 123/361 |
| 4,601,271 | 7/1986 | Ejiri et al. | 123/399 |
| 4,649,880 | 3/1987 | Asano et al. | 123/399 |
| 4,779,592 | 10/1988 | Takeuchi et al. | 123/399 |
| 4,785,782 | 11/1988 | Tanaka et al. | 123/361 |
| 4,831,985 | 5/1989 | Mabee et al. | 123/399 |
| 4,850,319 | 7/1989 | Imoehl | 123/361 |

FOREIGN PATENT DOCUMENTS

| | | | |
|---|---|---|---|
| 1023268 | 7/1958 | Fed. Rep. of Germany . | |
| 2358283 | 5/1975 | Fed. Rep. of Germany . | |
| 0196936 | 11/1984 | Japan | 123/361 |
| 0230520 | 11/1985 | Japan . | |

*Primary Examiner*—Tony M. Argenbright
*Assistant Examiner*—Robert E. Mates
*Attorney, Agent, or Firm*—Michael J. Striker

[57] ABSTRACT

A device for the controlled metering of combustion air into an internal combustion engine is described which allows an emergency driving operation and prevents the throttle valve from freezing shut in a rest position in the event of a failure of the electric actuator at the throttle valve or a failure of the control or the current supply of same. The device provides for a restoring spring in permanent engagement with the throttle valve shaft and a pretensioned counter-spring in partial engagement with the throttle valve shaft, which restoring spring and counter-spring cooperate with an electromotive actuator.

7 Claims, 2 Drawing Sheets

SYSTEM FOR REGULATED DOSING OF COMBUSTION AIR INTO INTERNAL COMBUSTION ENGINE

PRIOR ART

A device for adjusting the throttle valve of an internal combustion engine in a motor vehicle is known from the German Patent No. 10 23 268. This device comprises a slotted lever gearing by means of which, for one, the straight-line guidance of a gas pedal linkage is replaced by an oscillating guidance which is easier to lubricate. Secondly, an increased restoring force is produced by means of a spring, which is pretensioned between two fixed stops, and a rocker arm stop as soon as the actuating lever is positioned between a determined limiting position I and the maximum position II. Thus, a pressure point or action point is provided which tells the driver of the vehicle when a determined opening of the throttle flap has been achieved (kickdown threshold). By means of a suitable shaping of the contour of the gearing slot in the slotted lever, this device enables, in a purely mechanical manner, a transmission ratio of the accelerator pedal position onto the throttle valve position in a manner so as not to preserve the angles unaltered, but rather so as to be specifically adapted to the vehicle or engine, for example, so that a non-proportional dependency of the throttle valve position on the accelerator pedal position can also be realized in an easy manner. However, this known solution provides no measures either for making available an emergency driving function or for preventing the throttle valve from freezing fast.

As a rule, in newer systems for mixture metering which operate electronically a mechanical coupling between the accelerator pedal and throttle valve is dispensed with. Rather, in such systems the throttle valve is driven or adjusted by an electromotive actuator which receives correction commands directly from an electronic control device via an electrical line; for this purpose, the same electronic control device receives the driver's command from an accelerator pedal position transmitter also via an electrical line. Geared-down direct current motors (usually in a permanently excited construction) or so-called rotary actuators, which function in principle in a manner similar to a moving-coil instrument and occupy a determined position as a function of the average current intensity or the pulse duty factor of the operating current, respectively, in at least one regulating winding, are taken into consideration as electromotive actuators. In order to be able to operate such rotary actuators with the lowest possible electrical output, the spring constant of the restoring spring of the throttle valve cannot be made as large as desired. On the other hand, a desirably low drive output of such a rotary actuator is not sufficient under certain circumstances for "tearing loose" the throttle valve when the internal combustion engine is operating in the event that the throttle valve is frozen fast in its rest position.

In contrast, electronic systems for adjusting the throttle valve in an internal combustion engine can realize virtually any desired transmission ratios between the accelerator pedal position and the throttle valve position, e.g. by utilizing a characteristic line or family of characteristics filed in a digital storage.

Therefore, it is the object of the invention to provide a simple device in connection with timed electronic metering systems, which device allows a reliable drive of an air-metering throttle valve of an internal combustion engine with low power requirement and, in addition, eliminates the problem of a seizing throttle valve. Further, it is the object of the invention to design this device in such a way that a reliable emergency drive operation is nevertheless possible in the event of a failure of the current supply, the electronic control device for the throttle valve position or the actuator adjusting the throttle valve, so that the driver of the vehicle can drive the vehicle to the nearest repair shop in any case.

ADVANTAGES OF THE INVENTION

A first advantage of the invention consists in that the problem of the seizing of the throttle valve is overcome in that it is no longer possible for the throttle valve to freeze shut when the vehicle is turned off because, in this state, the throttle valve does not occupy a rest position in such a way that it can freeze shut along the surface area. In this way, the provision of corresponding peak power requirement for tearing loose a throttle valve which is frozen shut along the surface area is completely dispensed with, which leads to a low-cost design of the required controlling final stage in an electronic control device. As a further advantage, during failure of the electronic control device or its current supply or the controlling end stage contained in this control device for the throttle valve, the throttle valve occupies a rest position in every instance such that sufficient combustion air can reach the internal combustion engine for maintaining an emergency driving operation due to the returning action effected by means of a spring. Another advantage of the invention consists in that no additional electrical power need be made available when there is a decrease in the vehicle supply voltage during attempts at starting at lower ambient temperature in order only for sufficient combustion air to reach the internal combustion engine. Accordingly, the voltage position of the vehicle supply system is improved particularly during a high loading of the starter battery.

Advantageous developments of the invention, according to the invention, for electrically controlled metering of combustion air in an internal combustion engine are provided by means of the steps mentioned in the subclaims.

DRAWING

An embodiment example of the invention is shown in the drawing and explained in more detail in the following description.

DESCRIPTION OF THE EMBODIMENT EXAMPLE

Figure 1:
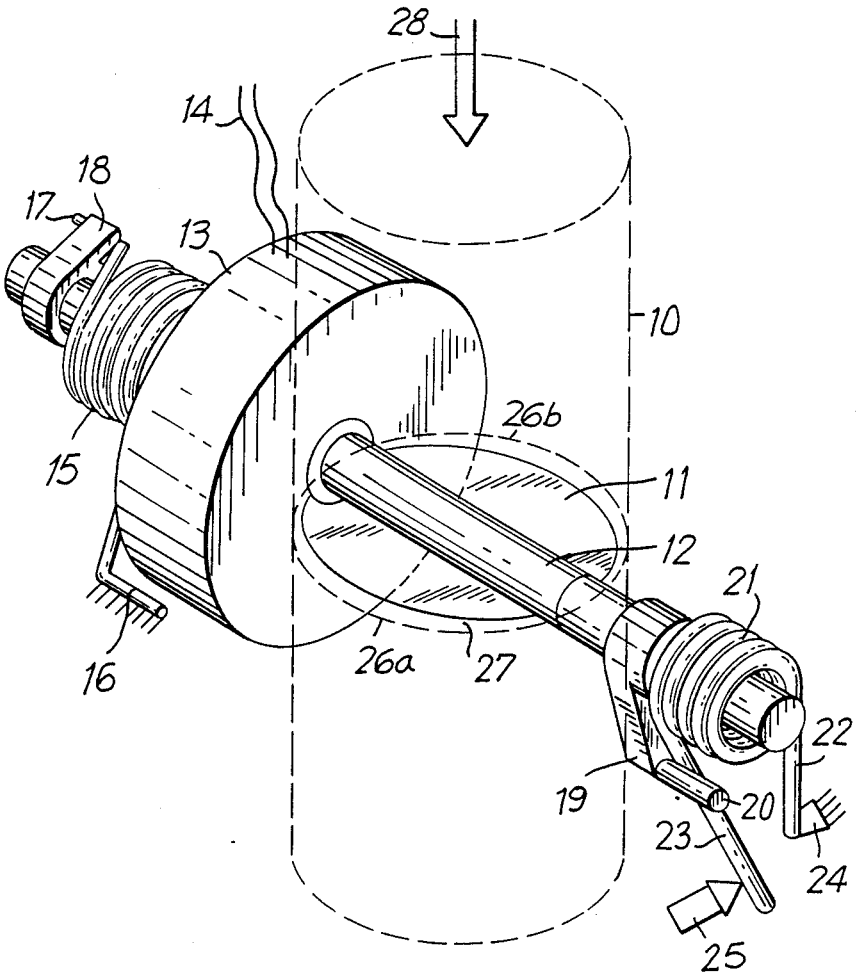
FIG. 1 shows a schematic functional diagram of the device, according to the invention, for the electrically controlled metering of combustion air in an internal combustion engine.

According to FIG. 1, the device, according to the invention, for the electrically controlled metering of combustion air in an internal combustion air comprises a channel 10 for guiding combustion air 28; a regulating shaft 12 projects through this channel 10, which regulating shaft 12 is supported so as to be rotatable and in turn carries a throttle valve 11 which is fastened thereon and is accordingly swivelable. The regulating shaft 12 is driven and positioned, respectively, by an electromotive actuator 13; the actuating signals necessary for this are fed to the rotary actuator via connection lines 14. The regulating shaft 12 carries a driver 18 which serves as a movable abutment for a first end 17 of a restoring spring 15. The second end 16 of this restoring spring 15 is fastened in a suitable manner so as to be stationary. The restoring spring 15 produces a certain restoring torque which strives to return the throttle valve 11 into the closed position. The lines **26*a* and 26*b* represent that surface line of the combustion air channel 10 against which the throttle valve 11 rests in the completely closed state, i.e. along which the throttle valve could freeze shut "along the surface area" along its entire circumference. In addition, the regulating shaft 12 carries an additional driver 19. A second counteraction spring 21 is tensioned in by its one end 22 so as to be stationary; the second end 23 contacts an abutment 25 which is adjustable tangentially relative to the regulating shaft 12, so that the spring is under a certain rest tension. The driver 19, which is connected with the regulating shaft 12 so as to be fixed with respect to rotation relative to it, comprises an abutment 20 which is guided against the resting end 23 of the counter-spring 21 as a rest bearing by means of the restoring spring 15 and by means of the restoring torque transmitted to the regulating shaft 12 via the driver 18. In this way, it is achieved that the throttle valve 11 does not close completely and that the electromotive actuator 13 must produce a torque whose mathematical sign changes in order to adjust the throttle valve from the maximum opening into the completely closed position, so that its boundary contacts the aforementioned surface lines 26*a* and 26*b*. In the state in which torque is absent, that is, when the actuator 13 is not supplied with voltage, the throttle valve 11 thus has a certain rest opening angle $\alpha_r$ which can be adjusted exactly by means of adjusting the adjustable stop element 25. It can be seen that when the vehicle is turned off the throttle valve 11 cannot freeze along its circumference in the area of the circumferential lines 26*a* and 26*b* in the completely closed state; in this instance, a connection is formed with the combustion air channel 10 only by means of the bearing support, not shown here, of the regulating shaft 12**, which can, however, be secured against freezing shut in a simple manner.

Figure 2:
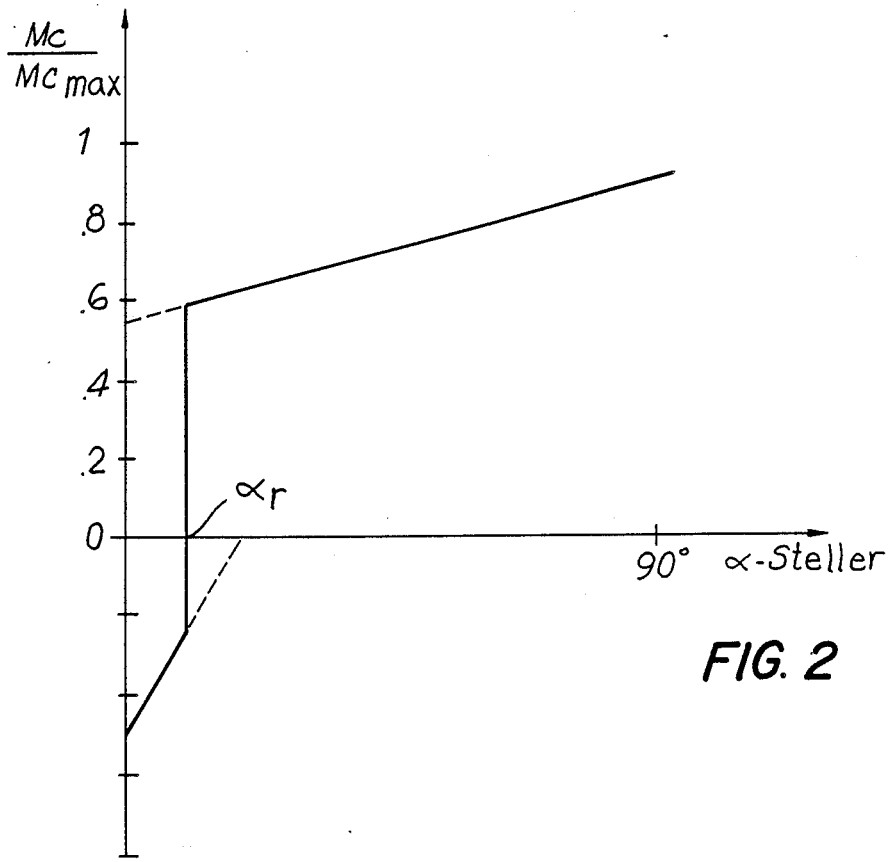
FIG. 2 shows a diagram of the basic curve of the torque of a throttle valve rotary actuator along the adjusting angle $\alpha$ of the throttle valve.

FIG. 2 illustrates the curve of the standardized torque Mc to be applied by the electromotive actuator 13 along the adjustment angle $\alpha$ of the throttle valve 11; at the rest angle $\alpha_r$ of the throttle valve, the mentioned reversal of direction of the adjusting torque is effected so that the electromotive actuator 13 must produce an adjusting torque with an opposite mathematical sign in order to bring the throttle valve 11 into the completely closed state. The increase of the moment line in the range $0<\alpha<\alpha_r$ results by means of superimposing the moment characteristic line for the spring 15 and for the counteraction spring 21.

Figure 3:
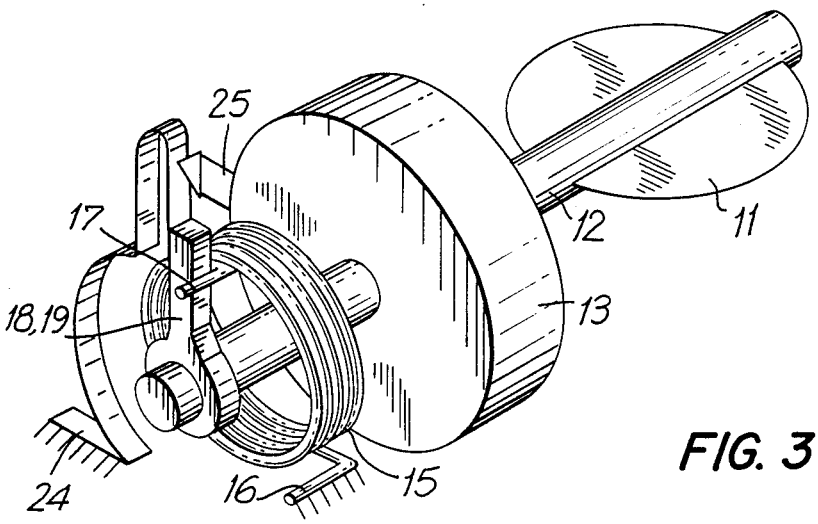
FIG. 3 shows a schematic view of a practical realization of the device, according to the invention.

The springs 15 and 21 can be constructed in different manners, e.g. in the form of helical springs or curved strip springs, without departing from the framework of the invention; the described elements can also be arranged so as to be distributed either on one side or at both sides of the throttle valve, as desired. In particular, the driver 18 can also be constructed as an abutment for the restoring spring 15 and the driver 19 with the abutment 20 for the counter-spring 21 can be constructed as an integrated whole in that the two springs then act on a single driver element which is connected with the regulating shaft so as to be fixed with respect to rotation relative to it, as is illustrated in FIG. 3 for the sake of completeness.

I claim:

1. Device for the controlled metering of combustion air in an internal combustion engine, comprising a combustion air channel (10), a throttle valve (11) arranged in the combustion air channel (10), which throttle valve (11) is fastened at a rotatable regulating shaft (12), and comprising a first restoring spring (15) which is fastened on one side in a stationary manner and introduces a torque in the regulating shaft in a permanent engagement with the regulating shaft, which torque is directed in the closing direction of the throttle valve, characterized in that there is an electromotive torque producing element in the form of an actuator which is connected with the regulating shaft so as to be fixed with respect to rotation relative to it, in that the throttle valve (11) can be guided by means of the restoring spring (15) into a rest position of the smallest opening ($\alpha_r>0$) against a stop which is spring-loaded by means of a counter-spring (21), and in that the electromotive actuator can be controlled for the complete closing of the throttle valve in such a way that it produces a torque which is directed opposite the torque for the maximum opening of the throttle valve.

2. Device according to claim 1, characterized in that the spring constant of the counter-spring (21) is greater than that of the restoring spring (15).

3. Device according to claim 1, characterized in that the counter-spring (21) is fastened at one end in a stationary manner, and in that the other end of the counter-spring can be pretensioned by means of an abutment which is adjustable in the circumferential direction of the regulating shaft when the throttle valve is opened.

4. Device according to claim 3, characterized in that the adjustable abutment (25) is constructed in particular in such a way that by means of its adjustment it allows the smallest opening angle ($\alpha_r$) of the throttle valve (11) to be fixed when the actuator (13) is not supplied with current.

5. Device according to claim 1, characterized in that the restoring spring (15) and the counter-spring (21) are arranged on different sides of the throttle valve (11) so as to act at the regulating shaft (12).

6. Device according to claim 1, characterized in that the introduction of the restoring torque from the restoring spring (15) into the regulating shaft (12) is effected by means of a driver (18 and 19) which is substantially identical to the driver abutting at the counter-spring (21).

7. Device according to claim 1, characterized in that both the restoring spring (15) and the counter-spring (21) are arranged on the same side of the throttle valve at the regulating shaft (12).

* * * * *